US007182280B2

(12) United States Patent
Ye et al.

(10) Patent No.: US 7,182,280 B2
(45) Date of Patent: Feb. 27, 2007

(54) DC POWER SPRAYING TOOL

(75) Inventors: Zhang Gen Ye, Jinhua Zhejiang (CN); Hu Su Zhou, Jinhua Zhejiang (CN)

(73) Assignee: Jinhua Jinshun Tools Co., Ltd., Jinhua Zhejiang (CN)

( * ) Notice: Subject to any disclaimer, the term of this patent is extended or adjusted under 35 U.S.C. 154(b) by 357 days.

(21) Appl. No.: 10/441,485

(22) Filed: May 19, 2003

(65) Prior Publication Data

US 2004/0251321 A1 Dec. 16, 2004

(51) Int. Cl.
*B05B 9/03* (2006.01)

(52) U.S. Cl. ..... 239/526; 239/332; 239/337; 222/333

(58) Field of Classification Search ..... 239/525, 239/526, 332, 331, 375, 288, 288.5, 533.1, 239/337; 417/411; 222/333
See application file for complete search history.

(56) References Cited

U.S. PATENT DOCUMENTS 2,925,202 A * 2/1960 Stevens ..... 222/190
3,455,507 A * 7/1969 Ryder et al. ..... 239/215
3,899,134 A * 8/1975 Wagner ..... 239/332
3,993,250 A * 11/1976 Shure ..... 239/332
4,705,995 A * 11/1987 Boll ..... 318/129
5,121,884 A * 6/1992 Noakes ..... 239/691
5,150,841 A * 9/1992 Silvenis et al. ..... 239/332
6,189,811 B1 * 2/2001 Rudy ..... 239/375

* cited by examiner

*Primary Examiner*—Eric Keasel
*Assistant Examiner*—Craig Schneider
(74) *Attorney, Agent, or Firm*—Raymond Y. Chan; David and Raymond Patent Group

(57) ABSTRACT

A DC power spraying tool includes a housing having an inlet opening, a discharging opening, and a motor cavity, a liquid container for containing a liquid colorant therein communicatively connected to the inlet opening of the housing, a spray nozzle extended from the discharging opening of the housing to communicate with the liquid container, and an electric motor supported within the motor cavity of the housing for applying a vacuum pressure on the liquid container to pump the colorant towards the spray nozzle. A DC power source includes a rechargeable battery supported by the housing for applying a DC current and a control circuitry electrically connected the rechargeable battery with the electric motor for transforming the DC current to an impulse current so as to drive the electric motor to operate.

8 Claims, 5 Drawing Sheets

DC POWER SPRAYING TOOL

BACKGROUND OF THE PRESENT INVENTION

1. Field of Invention

The present invention relates to a spraying tool, and more particularly to a DC power spraying tool, wherein the spraying tool is powered by a rechargeable battery to provide a direct current as the power source, so that the spraying tool is embodied as a cordless spraying tool to enhance the portability of the spraying tool.

2. Description of Related Arts

A conventional spray gun generally comprises a gun body having a discharging opening operatively connected to a spray nozzle and an inlet opening, a liquid reservoir for containing a colorant therein communicatively connected with the inlet opening of the gun body, and a pressurized motor electrically connected to a power source for pumping the colorant from the liquid reservoir on a surface through the spray nozzle. However, the conventional spray gun has several drawbacks.

When the spray gun is electrically connected to the power source through a connecting cable, the movement of the operator is limited to the length of the connecting cable. In other words, the freedom of movement of the operator is restricted so as to limit the distance the operator may be from the power source. Therefore, the operator is unable to operate the spray gun under certain circumstances such as an outdoor area that the power source is distance from the operator or a construction area that the electricity is unavailable. In addition, the operator may be in jeopardy as the operator may trip on the connecting cable.

Furthermore, the power source provides an AC current to the spray gun to drive the pressurized motor. The AC current, which is either 120V, 60 Hz or 220V~240V, 50 Hz, is directly input to the spray gun. Due to the high voltage input, the spray gun must employ with a transformer for adjusting the electric input to predetermined safety working voltage to the pressurized motor. There is always jeopardy for the operator accidentally getting an electric shock due to the electric leakage of the spray gun. However, during the spraying operation, the AC power source can provide enough power in order to drive the pressurized motor to pump the colorant from the liquid reservoir towards the spray nozzle.

Another drawback of the conventional spray gun is that the spray nozzle is affixed to the discharging opening of the gun body such that during spraying operation, a vibration force produced by the pressurized motor is exerted to the gun body and the spray nozzle. Therefore, the vibration of the gun body, which is considered as the noise pollution, will cause the colorant unevenly spraying on the surface. In addition, due to the structural design of the gun body, the cleaning process and the repairing process of the spray nozzle are complicated and costly.

SUMMARY OF THE PRESENT INVENTION

A main object of the present invention is to provide a DC power spraying tool, wherein the spraying tool is powered by a rechargeable battery to provide a direct current as the power source. Therefore, the spraying tool of the present invention is embodied as a cordless spraying tool to enhance the portability of the spraying tool.

Another object of the present invention is to provide a DC power spraying tool, wherein the spraying tool comprises a current transforming device for transforming a direct current to an impulse current having 50 Hz to 140 Hz, so as to drive the pressurized motor for the spraying operation.

Another object of the present invention is to provide a DC power spraying tool, wherein the spraying tool further comprises a vibration absorbing unit mounted to the pressurized motor for reducing the vibration force caused by the pressurized motor so as to enhance the spraying operation of the spraying tool.

Another object of the present invention is to provide a DC power spraying tool, wherein the spraying nozzle unit can be simply disassembled from the housing so as to enhance the cleaning process and the repairing purpose of the spraying nozzle unit.

Accordingly, in order to accomplish the above objects, the present invention provides a DC power spraying tool, comprising:

a housing having an inlet opening, a discharging opening, and a motor cavity;

a liquid container for containing a liquid colorant therein communicatively connected to the inlet opening of the housing;

a spray nozzle extended from the discharging opening of the housing to communicate with the liquid container;

an electric motor supported within the motor cavity of the housing for applying a vacuum pressure on the liquid container to pump the colorant towards the spray nozzle; and a DC power source comprising a rechargeable battery supported by the housing for applying a DC current and a control circuitry electrically connected the rechargeable battery with the electric motor for transforming the DC current to an impulse current so as to drive the electric motor to operate.

These and other objectives, features, and advantages of the present invention will become apparent from the following detailed description, the accompanying drawings, and the appended claims.

DETAILED DESCRIPTION OF THE PREFERRED EMBODIMENT

Figure 1:
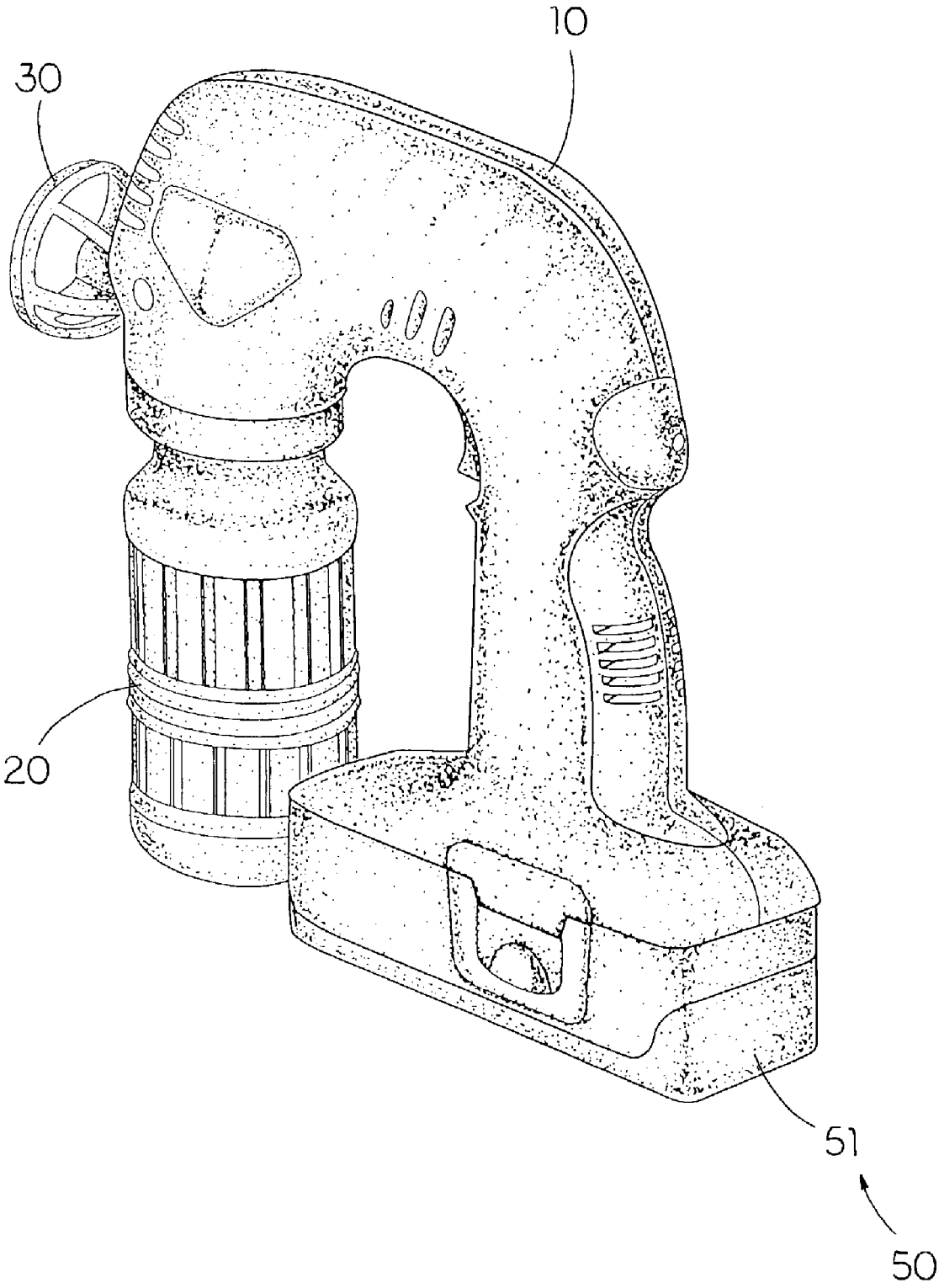
FIG. 1 is a perspective view of a DC power spraying tool according to a preferred embodiment of the present invention.
Figure 2:
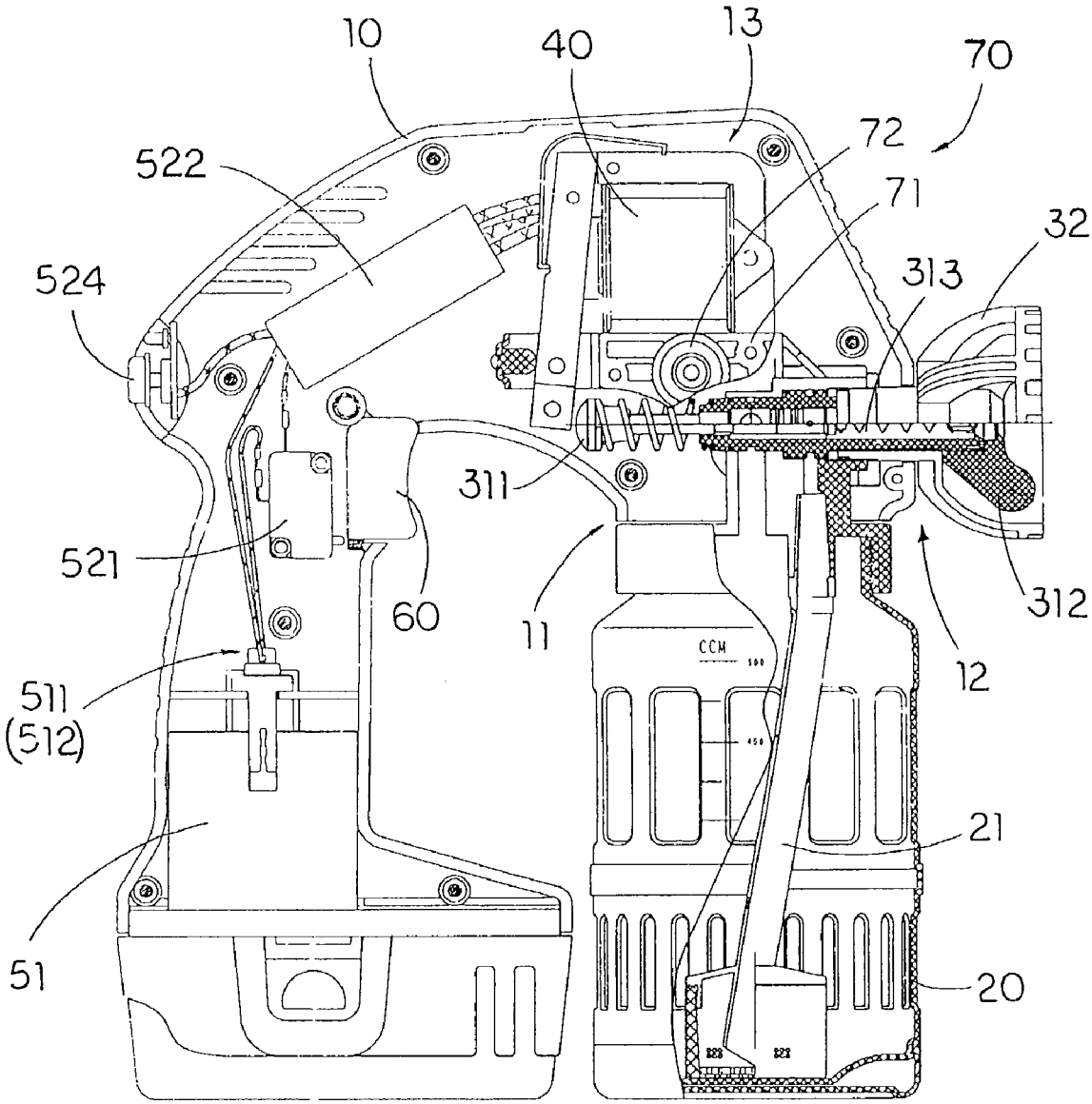
FIG. 2 is a sectional view of the DC power spraying tool according to the above preferred embodiment of the present invention.

Referring to FIGS. 1 and 2 of the drawings, a DC power spraying tool according to a preferred embodiment of the present invention is illustrated, wherein the DC power spraying tool comprises a housing 10 having an inlet opening 11, a discharging opening 12 communicating with the inlet opening 11 and a motor cavity 13, a liquid container 20 for containing a liquid colorant therein communicatively connected to the inlet opening 11 of the housing 10.

The DC power spraying tool further comprises a spray nozzle 30 extended from the discharging opening 12 of the housing 10 to communicate with the liquid container 20, an electric motor 40 supported within the motor cavity 13 of the housing 10 for applying a vacuum pressure on the liquid container 20 to pump the colorant towards the spray nozzle 30, and a DC power source 50 comprising a rechargeable battery 51 supported by the housing 10 for applying a DC current and a control circuitry 52 electrically connected the rechargeable battery 51 with the electric motor 40 for transforming the DC current to an impulse current so as to drive the electric motor 40 to operate.

According to the preferred embodiment, the rechargeable battery 51 has a first terminal 511 and a second terminal 512 embodied as a positive terminal and a negative terminal respectively.

Figure 3:
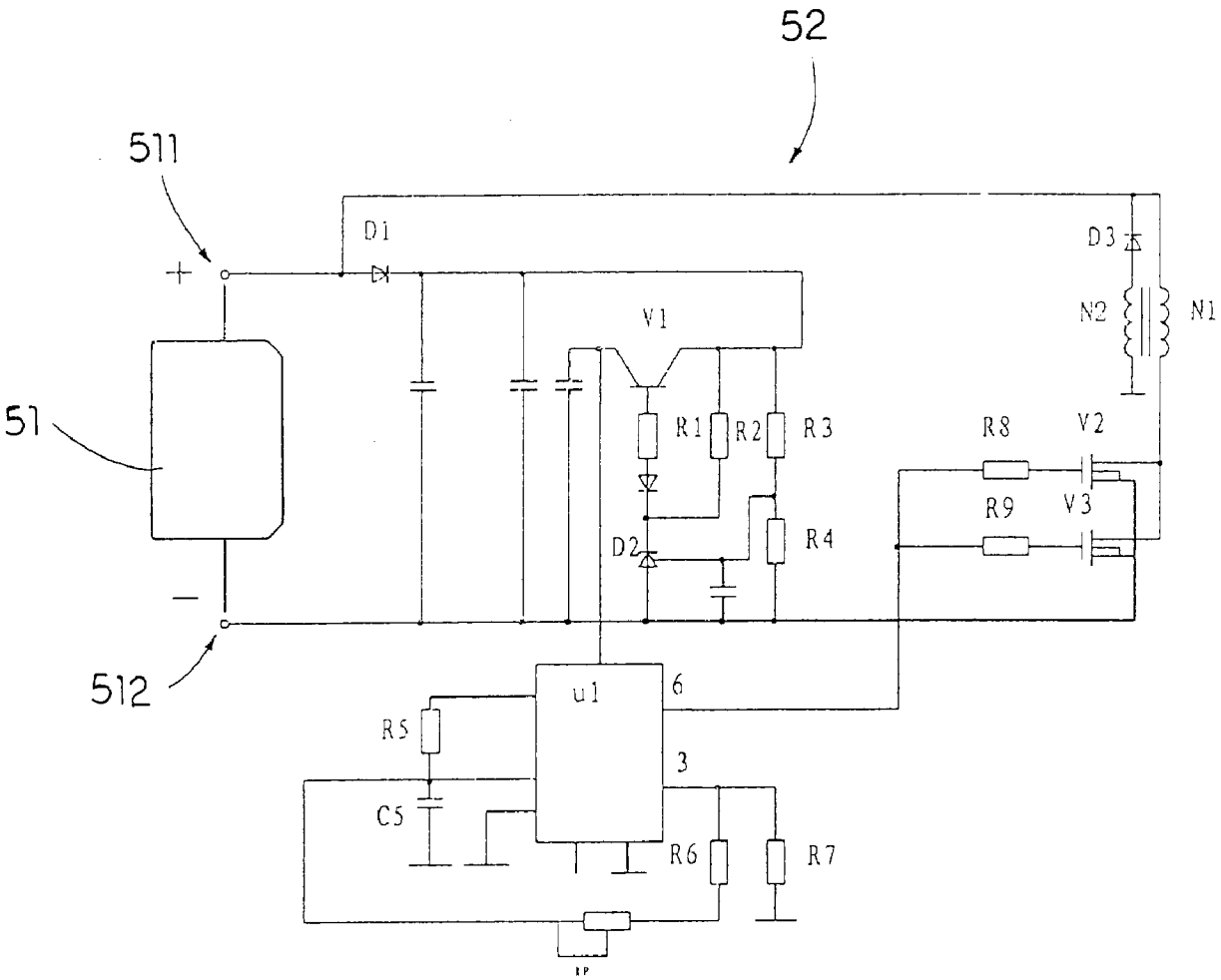
FIG. 3 is a circuit diagram of a control circuitry of the DC power spraying tool according to the above preferred embodiment of the present invention.

FIG. 3 illustrates the circuit diagram of the control circuitry 52 wherein the first and second terminals 511, 512 of the rechargeable battery 51 are electrically connected to the control circuitry 52. The control circuitry 52 is arranged to transform the direct current to the impulse current by selectively adjusting an oscillation frequency having a range from 50 Hz to 140 Hz. For example, when the electric input from the rechargeable battery 51 is between 16V and 20V, the control circuitry 52 is activated to provide the oscillation frequency. Therefore, by selectively inputting the electric input, the oscillation frequency will be adjusted correspondingly.

Figure 4:
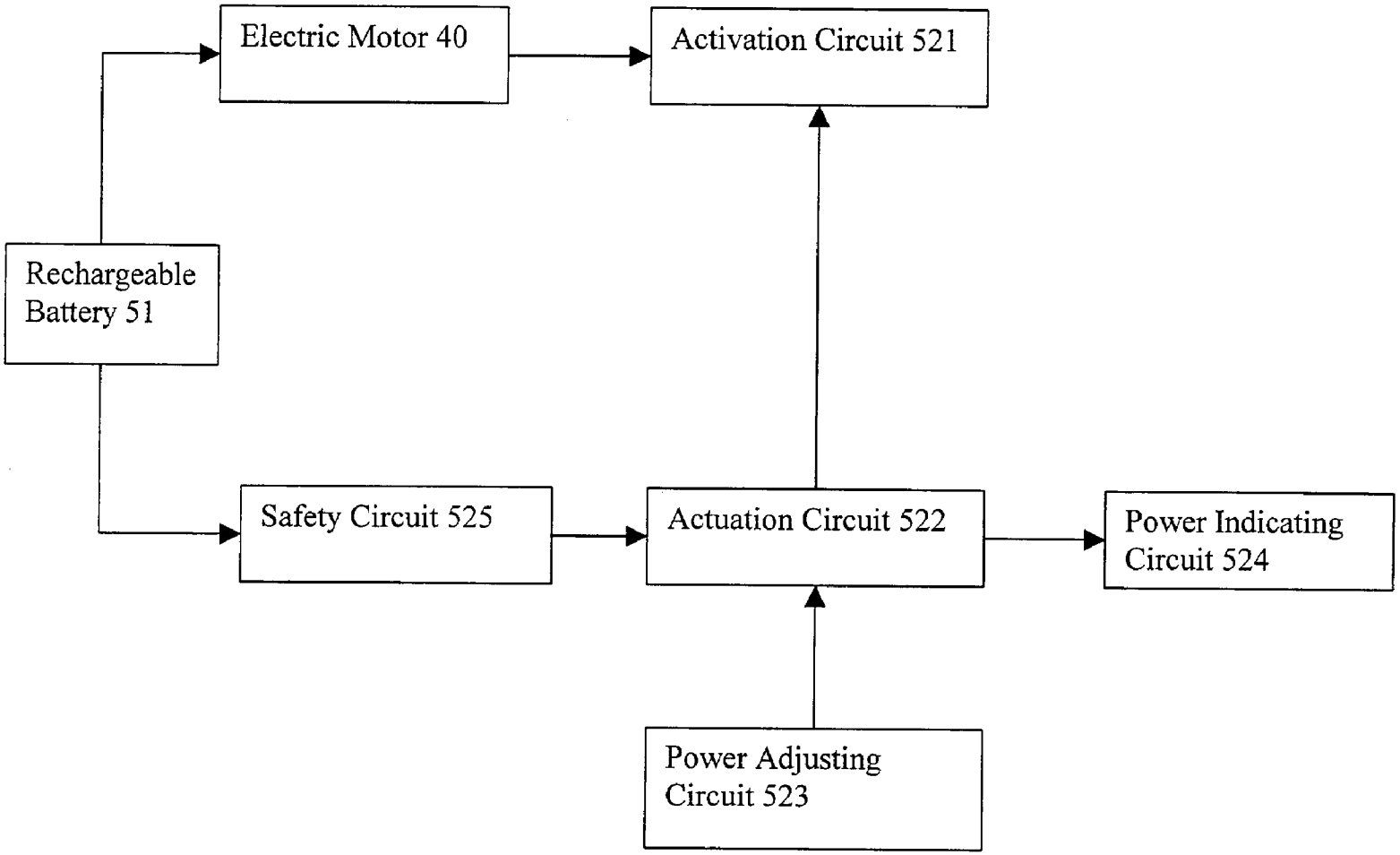
FIG. 4 is a block diagram of the control circuitry of the DC power spraying tool according to the above preferred embodiment of the present invention.

As shown in FIG. 4, the control circuitry 52 comprises an activation circuit 521 electrically connected to the first terminal 511 of the rechargeable battery 51 through the electric motor 40, and an actuation circuit 522 electrically connected between the second terminal 512 of the rechargeable battery 51 and the activation circuit 521 in such a manner that when the activation circuit 521 is activated, the actuation circuit 522 is triggered to drive the electric motor 40 to provide the vacuum pressure to suck the colorant from the liquid container 20 through a suction tube 21 to the spray nozzle 30.

The control circuitry 52 further comprises a power adjusting circuit 523 electrically connected to the actuation circuit 522 for selectively adjusting a frequency of the impulse current to the electric motor 40 and a power indicating circuit 524 electrically connected to the actuation circuit 522 for providing an indication signal when the actuation circuit 522 is triggered.

The control circuitry 52 further comprises a safety circuit 525 electrically connected between the second terminal 512 of the rechargeable battery 51 and the actuation circuit 522 for regulating the DC current from the rechargeable battery 51 below a predetermined safety current. In other words, when the DC current input from the rechargeable battery 51 is higher than the safety current, the safety circuit 525 automatically cuts off the electrical connection between the rechargeable battery 51 and the electric motor 40, so as to prevent the short circuit of the control circuitry 52.

As shown in FIG. 2, the DC power spraying tool further comprises a trigger switch 60 pivotally mounted on the housing 10 to actuate the activation circuit 521 in such a manner that when the activation circuit 521 is triggered via the trigger switch 60, the direct current from the rechargeable battery 51 flows to the electric motor 40 through the control circuitry 52.

Figure 5:
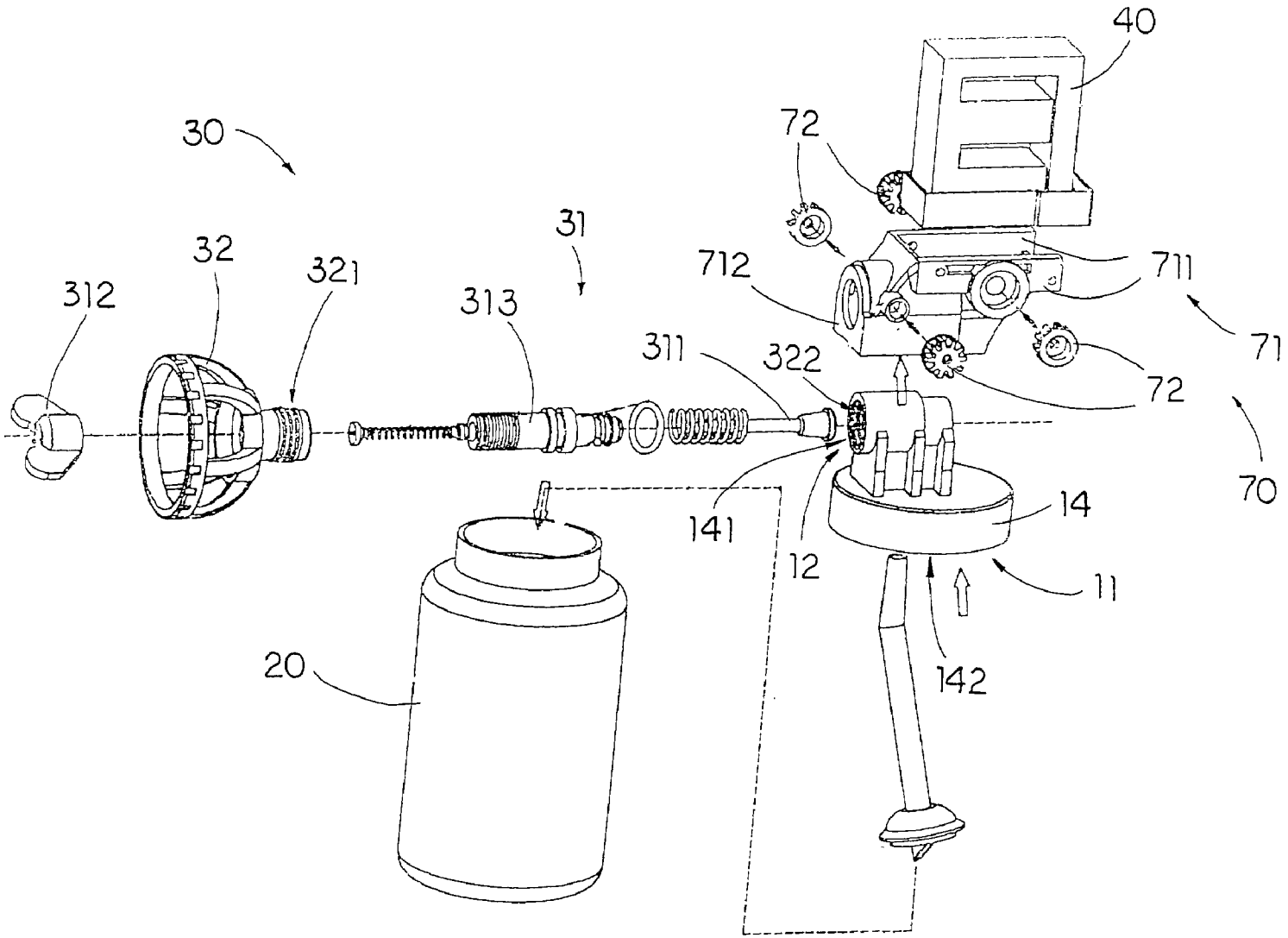
FIG. 5 is a partially exploded perspective view of the DC power spraying tool according to the above preferred embodiment of the present invention.

As shown in FIG. 5, the housing 10 further comprises a supporting base 14 having a nozzle channel 141 defining the discharging opening 12 for the spray nozzle 30 slidably inserting into the nozzle channel 141 through the discharging opening 12 and a container holder 142 forming as the inlet opening 11 to substantially hold the liquid container 20 in position, wherein the electric motor 40 is supported on the supporting base 14 for applying the vacuum pressure to pump the colorant to the spray nozzle 30 through the nozzle channel 141.

As shown in FIG. 5, the DC power spraying tool further comprises a vibration absorbing unit 70 supported within the motor cavity 13 to support the electric motor 40 for reducing a vibration force caused by the electric motor 40 while operation. The vibration absorbing unit 70 comprises a motor supporting frame 71 comprises two supporting arms 711 to receive the electric motor 40 therebetween, and at least two vibration absorbing elements 72 sidewardly extended from two outer sides of the supporting arms 711 towards two inner sidewalls of the housing 10 respectively in such a manner that while operating the electric motor 40, the vibration force therefrom is substantially reduced through the vibration absorbing elements 72 towards the housing 10.

As shown in FIG. 5, the motor supporting frame 71, which is rigidly supported on the supporting base 14, further comprises a channel socket 712 fittingly received the nozzle channel 141 therein such that when the spray nozzle 30 is slidably inserted into the nozzle channel 141 through the channel socket 712, the motor supporting frame 71 is locked up on the supporting base 14, so as to retain the electric motor 40 in position.

Accordingly, the motor supporting frame 71 is preferably made of plastic that the supporting arms 711 are capable of reducing the vibration force from the electric motor 40. In addition, the vibration absorbing elements 72 are made of rubber which is capable of minimizing the vibration force transferring from the electric motor 40 to the housing 10.

As shown in FIG. 5, the spray nozzle 30, which is detachably mounted to the discharging opening 12 of the housing 10, comprises a nozzle unit 31 slidably inserted into the nozzle channel 141 of the supporting base 14 to communicate with the liquid container 20 through the container holder 142 and a locking member 32 detachably locking the nozzle unit 31 at the nozzle channel 141 of the supporting base 14.

The nozzle unit 31 comprises a nozzle valve 311 provided at the discharging opening 12 of the housing 10, a nozzle head 312 and a nozzle body 313 communicatively extended from the nozzle valve 311 to the nozzle head 312 wherein the nozzle valve 311 is arranged to be actuated for allowing the colorant passing to the nozzle head 312 through the nozzle body 313 while the vacuum pressure from the electric motor 40 is applied on the liquid container 20.

The locking member 32 has an outer threaded portion 321 rotatably engaged with a corresponding inner thread portion 322 of the nozzle channel 141 of the supporting base 14 so as to detachably lock up the nozzle unit 31 with the nozzle channel 141 at the discharging opening 12 of the housing 10.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure form such principles. Therefore, this invention includes all modifications encompassed within the spirit and scope of the following claims.

What is claimed is:

1. A DC power spraying tool, comprising:

a housing having an inlet opening, a discharging opening communicating with said inlet opening, and a motor cavity;

a liquid container for containing a liquid colorant therein communicatively connected to said inlet opening of said housing;

a spray nozzle extended from said discharging opening of said housing to communicate with said liquid container;

an electric motor supported within said motor cavity of said housing for applying a vacuum pressure on said liquid container to pump said colorant towards said spray nozzle;

a DC power source comprising a rechargeable battery, having an electric output between 16V and 20V, supported by said housing for applying a DC current and a control circuitry electrically connected said rechargeable battery with said electric motor to generate an oscillation frequency for transforming said DC current to an impulse current so as to drive said electric motor to operate; and a motor supporting frame which is supported within said motor cavity and comprises two supporting arms to receive said electric motor therebetween, wherein said housing further comprises a supporting base having a nozzle channel defining said discharging opening for said spray nozzle slidably inserting into said nozzle channel through said discharging opening in a detachably attaching manner and a container holder forming as said inlet opening to substantially hold said liquid container in position, such that said spray nozzle is allowed to be detached from said housing for cleaning and replacing purpose, wherein said electric motor is supported on said supporting base for applying said vacuum pressure to pump said colorant to said spray nozzle through said nozzle channel, wherein said motor supporting frame further comprises at least two vibration absorbing elements sidewardly extended from two outer sides of said supporting arms towards two inner sidewalls of said housing respectively in such a manner that said vibration absorbing elements are capable of reducing a vibration force from said electric motor towards said housing while operating said electric motor.

2. The DC power spraying tool, as recited in claim 1, wherein said motor supporting frame, which is rigidly supported on said supporting base, further comprises a channel socket fittingly received said nozzle channel therein such that when said spray nozzle is slidably inserted into said nozzle channel through said channel socket, said motor supporting frame is locked up on said supporting base, so as to retain said electric motor in position.

3. A DC power spraying tool, comprising:

a housing having an inlet opening, a discharging opening communicating with said inlet opening, and a motor cavity;

a liquid container for containing a liquid colorant therein communicatively connected to said inlet opening of said housing;

a spray nozzle extended from said discharging opening of said housing to communicate with said liquid container;

an electric motor supported within said motor cavity of said housing for applying a vacuum pressure on said liquid container to pump said colorant towards said spray nozzle;

a DC power source comprising a rechargeable battery, having an electric output between 16V and 20V, supported by said housing for applying a DC current and a control circuitry electrically connected said rechargeable battery with said electric motor to generate an oscillation frequency for transforming said DC current to an impulse current so as to drive said electric motor to operate; and a motor supporting frame which is supported within said motor cavity and comprises two supporting arms to receive said electric motor therebetween, wherein said control circuitry comprises an activation circuit electrically connected to a first terminal of said rechargeable battery through said electric motor, and an actuation circuit electrically connected between a second terminal of said rechargeable battery and said activation circuit in such a manner that when said activation circuit is activated, said actuation circuit is triggered to drive said electric motor for providing said vacuum pressure to suck said colorant from said liquid container to said spray nozzle, wherein said control circuitry further comprises a power adjusting circuit electrically connected to said actuation circuit for selectively adjusting said oscillation frequency of said impulse current output to said electric motor, wherein said control circuitry further comprises a safety circuit electrically connected between said terminal of said rechargeable battery and said actuation circuit for regulating said DC current from said rechargeable battery below a predetermined safety current, wherein when said DC current input from said rechargeable battery is higher than said safety current, said safety circuit automatically cuts off an electrical connection between said rechargeable battery and said electric motor, wherein said housing further comprises a supporting base having a nozzle channel defining said discharging opening for said spray nozzle slidably inserting into said nozzle channel through said discharging opening in a detachably attaching manner and a container holder forming as said inlet opening to substantially hold said liquid container in position, such that said spray nozzle is allowed to be detached from said housing for cleaning and replacing purpose, wherein said electric motor is supported on said supporting base for applying said vacuum pressure to pump said colorant to said spray nozzle through said nozzle channel, wherein said motor supporting frame further comprises at least two vibration absorbing elements sidewardly extended from two outer sides of said supporting arms towards two inner sidewalls of said housing respectively in such a manner that said vibration absorbing elements are capable of reducing a vibration force from said electric motor towards said housing while operating said electric motor.

4. The DC power spraying tool, as recited in claim 3, wherein said motor supporting frame, which is rigidly supported on said supporting base, further comprises a channel socket fittingly received said nozzle channel therein such that when said spray nozzle is slidably inserted into said nozzle channel through said channel socket, said motor supporting frame is locked up on said supporting base, so as to retain said electric motor in position.

5. A DC power spraying tool, comprising:

a housing having an inlet opening, a discharging opening communicating with said inlet opening, and a motor cavity;

a liquid container for containing a liquid colorant therein communicatively connected to said inlet opening of said housing;

a spray nozzle extended from said discharging opening of said housing to communicate with said liquid container;

an electric motor supported within said motor cavity of said housing for applying a vacuum pressure on said liquid container to pump said colorant towards said spray nozzle;

a DC power source comprising a rechargeable battery, having an electric output between 16V and 20V, supported by said housing for applying a DC current and a control circuitry electrically connected said rechargeable battery with said electric motor to generate an oscillation frequency for transforming said DC current to an impulse current so as to drive said electric motor to operate; and a motor supporting frame which is supported within said motor cavity and comprises two supporting arms to receive said electric motor therebetween, wherein said control circuitry comprises an activation circuit electrically connected to a first terminal of said rechargeable battery through said electric motor, and an actuation circuit electrically connected between a second terminal of said rechargeable battery and said activation circuit in such a manner that when said activation circuit is activated, said actuation circuit is triggered to drive said electric motor for providing said vacuum pressure to suck said colorant from said liquid container to said spray nozzle, wherein said control circuitry further comprises a power adjusting circuit electrically connected to said actuation circuit for selectively adjusting said oscillation frequency of said impulse current output to said electric motor, wherein said control circuitry further comprises a safety circuit electrically connected between said terminal of said rechargeable battery and said actuation circuit for regulating said DC current from said rechargeable battery below a predetermined safety current, wherein when said DC current input from said rechargeable battery is higher than said safety current, said safety circuit automatically cuts off an electrical connection between said rechargeable battery and said electric motor, wherein said impulse current has a frequency having a range from 50 Hz to 140 Hz, wherein said housing further comprises a supporting base having a nozzle channel defining said discharging opening for said spray nozzle slidably inserting into said nozzle channel through said discharging opening in a detachably attaching manner and a container holder forming as said inlet opening to substantially hold said liquid container in position, such that said spray nozzle is allowed to be detached from said housing for cleaning and replacing purpose, wherein said electric motor is supported on said supporting base for applying said vacuum pressure to pump said colorant to said spray nozzle through said nozzle channel, wherein said motor supporting frame further comprises at least two vibration absorbing elements sidewardly extended from two outer sides of said supporting arms towards two inner sidewalls of said housing respectively in such a manner that said vibration absorbing elements are capable of reducing a vibration force from said electric motor towards said housing while operating said electric motor.

6. The DC power spraying tool, as recited in claim 5, wherein said motor supporting frame, which is rigidly supported on said supporting base, further comprises a channel socket fittingly received said nozzle channel therein such that when said spray nozzle is slidably inserted into said nozzle channel through said channel socket, said motor supporting frame is locked up on said supporting base, so as to retain said electric motor in position.

7. The DC power spraying tool, as recited in claim 5, wherein said spray nozzle, which is detachably mounted to said discharging opening of said housing, comprises a nozzle unit slidably inserted into said nozzle channel of said supporting base to communicate with said liquid container through said container holder and a locking member having an outer threaded portion rotatably engaged with an inner threaded portion of said nozzle channel so as to detachably locking said nozzle unit within said nozzle channel at said discharging opening of said housing.

8. The DC power spraying tool, as recited in claim 6, wherein said spray nozzle, which is detachably mounted to said discharging opening of said housing, comprises a nozzle unit slidably inserted into said nozzle channel of said supporting base to communicate with said liquid container through said container holder and a locking member having an outer threaded portion rotatably engaged with an inner threaded portion of said nozzle channel so as to detachably locking said nozzle unit within said nozzle channel at said discharging opening of said housing.

* * * * *